US009802224B2

(12) United States Patent
Dekker et al.

(10) Patent No.: US 9,802,224 B2
(45) Date of Patent: Oct. 31, 2017

(54) ULTRASOUND TRANSDUCER DEVICE AND METHOD OF MANUFACTURING THE SAME

(71) Applicant: KONINKLIJKE PHILIPS N.V., Eindhoven (NL)

(72) Inventors: Ronald Dekker, Eindhoven (NL); Bout Marcelis, Eindhoven (NL); Marcel Mulder, Eindhoven (NL); Ruediger Mauczok, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 663 days.

(21) Appl. No.: 14/365,647

(22) PCT Filed: Dec. 13, 2012

(86) PCT No.: PCT/IB2012/057273

§ 371 (c)(1),
(2) Date: Jun. 16, 2014

(87) PCT Pub. No.: WO2013/093728

PCT Pub. Date: Jun. 27, 2013

(65) Prior Publication Data

US 2014/0307528 A1 Oct. 16, 2014

Related U.S. Application Data

(60) Provisional application No. 61/577,704, filed on Dec. 20, 2011.

(51) Int. Cl.
*B06B 1/00* (2006.01)
*B06B 1/02* (2006.01)

(52) U.S. Cl.
CPC ..... *B06B 1/0292* (2013.01); *Y10T 29/49005* (2015.01)

(58) Field of Classification Search
USPC ..... 367/178
See application file for complete search history.

(56) References Cited

U.S. PATENT DOCUMENTS 7,846,102 B2 * 12/2010 Kupnik ..... B06B 1/0292 257/E21.002
8,299,685 B2 * 10/2012 Cho ..... B06B 1/0292 310/324

(Continued)

FOREIGN PATENT DOCUMENTS

EP 1908529 A2 4/2008

*Primary Examiner* — James Hulka

(57) ABSTRACT

The present invention relates to an ultrasound transducer device comprising at least one cMUT cell (30) for transmitting and/or receiving ultrasound waves, the cMUT cell (30) comprising a cell membrane (30*a*) and a cavity (30*b*) underneath the cell membrane. The device further comprises a substrate (10) having a first side (10*a*) and a second side (10*b*), the at least one cMUT cell (30) arranged on the first side (10*a*) of the substrate (10). The substrate (10) comprises a substrate base layer (12) and a plurality of adjacent trenches (17*a*) extending into the substrate (10) in a direction orthogonal to the substratesides (10*a*, 10*b*), wherein spacers (12*a*) are each formed between adjacent trenches (17*a*). The substrate (10) further comprises a connecting cavity (17*b*) which connects the trenches (17*a*) and which extends in a direction parallel to the substrate sides (10*a*, 10*b*), the trenches (17*a*) and the connecting cavity (17*b*) together forming a substrate cavity (17) in the substrate (10). The substrate (10) further comprises a substrate membrane (23) covering the substrate cavity (17). The substrate cavity (17) is located in a region of the substrate (10) underneath the cMUT cell (30). The present invention further relates to a method of manufacturing such ultrasound transducer device.

15 Claims, 17 Drawing Sheets

(56) References Cited

U.S. PATENT DOCUMENTS

| | | | | |
|---|---|---|---|---|
| 2003/0114760 | A1* | 6/2003 | Robinson | B06B 1/0685 600/459 |
| 2006/0170014 | A1* | 8/2006 | Smith | B06B 1/0292 257/252 |
| 2007/0215964 | A1* | 9/2007 | Khuri-Yakub | B06B 1/0292 257/414 |
| 2008/0048211 | A1* | 2/2008 | Khuri-Yakub | B06B 1/0292 257/204 |
| 2008/0212407 | A1* | 9/2008 | Caliano | B06B 1/0292 367/140 |
| 2008/0294055 | A1* | 11/2008 | Adachi | B06B 1/0292 600/463 |
| 2009/0079299 | A1* | 3/2009 | Bradley | G01S 15/8925 310/322 |
| 2009/0122651 | A1 | 5/2009 | Kupnik et al. | |
| 2010/0173437 | A1* | 7/2010 | Wygant | B06B 1/0292 438/53 |
| 2011/0057541 | A1 | 3/2011 | Cho et al. | |
| 2011/0163630 | A1* | 7/2011 | Klootwijk | B06B 1/0292 310/300 |
| 2014/0005521 | A1* | 1/2014 | Kohler | A61B 8/0841 600/411 |
| 2014/0247698 | A1* | 9/2014 | Dirksen | B06B 1/0292 367/189 |
| 2014/0251014 | A1* | 9/2014 | Dirksen | B06B 1/0292 73/632 |
| 2014/0293751 | A1* | 10/2014 | Dekker | B06B 1/0292 367/181 |
| 2014/0375168 | A1* | 12/2014 | Dirksen | B06B 1/0292 310/300 |
| 2015/0162852 | A1* | 6/2015 | Dirksen | B06B 1/0292 310/300 |
| 2015/0294663 | A1* | 10/2015 | Klootwijk | B06B 1/0292 367/140 |

* cited by examiner

ULTRASOUND TRANSDUCER DEVICE AND METHOD OF MANUFACTURING THE SAME

This application is the U.S. National Phase application under 35 U.S.C. §371 of International Application No. PCT/IB2012/057273, filed on Dec. 13, 2012, which claims the benefit of U.S. Provisional Application No. 61/577,704 filed on Dec. 20, 2011. These applications are hereby incorporated by reference herein.

FIELD OF THE INVENTION

The present invention relates to an ultrasound transducer device comprising at least one cMUT cell for transmitting and/or receiving ultrasound waves and a substrate on which the least one cMUT cell is arranged. The present invention further relates to a method of manufacturing such ultrasound transducer device.

BACKGROUND OF THE INVENTION

The heart of any ultrasound (imaging) system is the transducer which converts electrical energy in acoustic energy and back. Traditionally these transducers are made from piezoelectric crystals arranged in linear (1-D) transducer arrays, and operating at frequencies up to 10 MHz. However, the trend towards matrix (2-D) transducer arrays and the drive towards miniaturization to integrate ultrasound (imaging) functionality into catheters and guide wires has resulted in the development of so called capacitive micromachined ultrasound transducer (cMUT) cells. These cMUT cells can be placed or fabricated on top of an ASIC (Application Specific IC) containing the driver electronics and signal processing. This will result in significantly reduced assembly costs and the smallest possible form factor.

A cMUT cell comprises a cavity underneath the cell membrane. For receiving ultrasound waves, ultrasound waves cause the cell membrane to move or vibrate and the variation in the capacitance between the electrodes can be detected. Thereby the ultrasound waves are transformed into a corresponding electrical signal. Conversely, an electrical signal applied to the electrodes causes the cell membrane to move or vibrate and thereby transmitting ultrasound waves.

An important question with cMUT devices is how to reduce or suppress acoustic coupling of the ultrasound waves (or reverberation energy) to the substrate. In other words it is a question how to minimize undesired substrate interactions (such as reflections and lateral cross-talk) or coupling.

Another question is how the cMUT device is connected to the ASIC. There are multiple ways, in particular three general ways, how the connection between a cMUT device and an ASIC may be realized. FIG. 1*a-c* show the three different solutions of a cMUT device connected to an ASIC. The first solution shown in FIG. 1*a* is to place a separate cMUT device (substrate 1 and cMUT cells 3) on top of the ASIC 4 and use wire bonds 5 for the connections. This first solution is the most flexible and simplest solution. However, this solution is only attractive for linear arrays.

For 2D arrays the large number of interconnects between each cMUT device and the driving electronics makes it necessary to place each cMUT device directly on top of the driving electronics. The second solution is thus to process the cMUT cells 3 as a post processing step on top of an already processed ASIC 4, as shown in FIG. 1*b*. This yields a so-called "monolithic" device (one chip) where the cMUT cells are fabricated directly on top of the ASIC. Such "monolithic" devices are the smallest, thinnest devices and have the best performance in terms of added electrical parasitics. However, with this solution, in order to minimize undesired substrate interactions (such as reflections and lateral cross-talk), significant substrate modifications to the substrate underneath the cMUT cell may be required. These modifications may be at the worst case impossible on a CMOS substrate, or at the best case very difficult to implement because it may require process steps and/or materials which are incompatible with the technologies available or allowed in the foundry in which the combination of the cMUT device and the ASIC is fabricated. Compromises would have to be made that lead to suboptimal performance. Another challenge with this second solution of monolithic integration is that the ASIC process and the cMUT process are tightly linked, and that it will be difficult to change to e.g. the next CMOS process node.

A third, alternative solution is to use a suitable through-wafer via hole technology to electrically connect the cMUT cells 3 on the front side of the substrate 1 to contacts on the backside of the substrate 1, so that the substrate or device can be "flip-chipped" (e.g. by solder bumping) on the ASIC 4 (see FIG. 1*c*). This yields a so-called "hybrid" device (two chips) which comprises the cMUT device and the ASIC.

In one example the cMUT cells are fabricated with or in the substrate, thus with the same technology as the substrate. Such a cMUT device is for example disclosed in US 2009/0122651 A1. However, such device and/or its method of manufacturing needs to be further improved.

SUMMARY OF THE INVENTION

It is an object of the present invention to provide an improved ultrasound transducer device and/or method of manufacturing the same, in particular with improved performance and/or an improved way of manufacturing.

In a first aspect of the present invention an ultrasound transducer device is presented comprising at least one cMUT cell for transmitting and/or receiving ultrasound waves, the cMUT cell comprising a cell membrane and a cavity underneath the cell membrane. The device further comprises a substrate having a first side and a second side, the at least one cMUT cell arranged on the first side of the substrate. The substrate comprises a substrate base layer and a plurality of adjacent trenches extending into the substrate base layer in a direction orthogonal to the substrate sides, wherein spacers are each formed between adjacent trenches. The substrate further comprises a connecting cavity which connects the trenches and which extends in a direction parallel to the substrate sides, the trenches and the connecting cavity together forming a substrate cavity in the substrate. The substrate further comprises a substrate membrane covering the substrate cavity. The substrate cavity is located in a region of the substrate underneath the cMUT cell.

In a further aspect of the present invention a method of manufacturing an ultrasound transducer device is presented, the method comprising providing a substrate having a first side and a second side and having a substrate base layer, and forming a plurality of adjacent trenches extending into the substrate base layer in a direction orthogonal to the substrate sides, wherein spacers are each formed between adjacent trenches. The method further comprises forming a connecting cavity which connects the trenches and which extends in a direction parallel to the substrate sides, the trenches and the connecting cavity together forming a substrate cavity in the substrate. The method further comprises arranging a substrate membrane covering the substrate cavity, and arranging at least one cMUT cell on the first side of the substrate. The substrate cavity is located in a region of the substrate underneath the cMUT cell.

The basic idea of these aspects of the invention is to provide a "floating" membrane or membrane layer in the substrate underneath the cMUT cell. The "floating" substrate membrane covers or is arranged on a substrate cavity having a specific shape. The substrate cavity is formed within the substrate or substrate base layer (not between the substrate and an ASIC for example). The substrate cavity has trenches extending in a direction orthogonal to the substrate sides (e.g. vertical direction) and a connecting cavity which connects the trenches and extends in a direction parallel to the substrate sides (e.g. the horizontal or lateral direction). A trench generally refers to a cavity which has a depth bigger than its width. The connecting cavity can in particular be an "under-etched" portion. A spacer (made of the material of the substrate base layer) is formed between each two adjacent trenches. The spacers between the trenches can extend into the substrate cavity (in the direction orthogonal to the substrate sides). For example, the spacers are suspended to the substrate base layer (only) at an edge or side of the trenches or substrate cavity. In this way, the substrate is thinned, but at the same time still provides sufficient mechanical integrity or support.

The substrate membrane will inevitably always move a little bit when the cMUT cell transmits or receives ultrasound waves. The substrate membrane can be thin (to reduce the effect of reflection of ultrasound waves) and/or have a high mass (so that it will only move a little bit). The substrate cavity (and its "floating" membrane) is located in a region of the substrate underneath the cMUT cell. In other words the substrate cavity is located in a region of the substrate where (or underneath where) the cMUT cell is mounted or fabricated. In this way, acoustic coupling of the ultrasound waves to the substrate is reduced, and thus performance of the device is improved.

In one example of this solution the cMUT cells are fabricated in a separate dedicated technology, which is optimized for performance, and then mounted to the substrate. To provide the "floating" or "free standing" membrane underneath the cMUT cell is in particular possible in case of a "hybrid" device (without active devices).

Preferred embodiments of the invention are defined in the dependent claims. It shall be understood that the claimed method has similar and/or identical preferred embodiments as the claimed device and as defined in the dependent claims.

In one embodiment, the substrate cavity is located in at least the entire region of the substrate underneath the cell membrane of the cMUT cell. This further reduces the acoustic coupling of the ultrasound waves to the substrate.

In another embodiment, the substrate cavity has a pressure below the atmospheric pressure. This further reduces the acoustic coupling of the ultrasound waves to the substrate. In a variant of this embodiment, the substrate cavity has a pressure of 10 mBar or less.

In another embodiment, the substrate membrane comprises a non-conformally deposited layer arranged over the substrate cavity. In particular, the layer can be an oxide (e.g. silicone oxide) layer or nitride layer. The layer (e.g. by PECVD) is deposited with a poor or no conformality so that the substrate cavity (e.g. trenches or connecting cavity) can be easily covered or sealed (e.g. after several microns have been deposited). An oxide layer (e.g. deposited by PECVD) is particularly suitable as it deposits with a very poor or no conformality. However, alternatively also a Nitride layer (e.g. deposited by PECVD) can be used.

In a further embodiment, the substrate membrane comprises a high-density layer made of a high-density material. This further reduces acoustic coupling of the ultrasound waves to the substrate. This embodiment can also be implemented as an independent aspect.

In a variant of this embodiment, the high-density layer has a mass which is sufficient to provide an inertial force which substantially opposes the acoustic pressure force developed by the cMUT cell during transmission of the ultrasound waves. The mass can for example be selected by providing, for a specific high-density material, a suitable thickness of the layer.

In another embodiment, the cell membrane comprises a high-density layer made of a high-density material. In other words, a high-density layer is arranged on the cMUT cell, in particular the outer side of the cMUT cell. This improves the acoustic properties, in particular the coupling of the sound waves to fluid or fluid-like substances (e.g. body or water).

In a variant, the high-density material is or comprises Tungsten, Gold or Platinum. Tungsten is a particularly suitable high-density material, also from a processing point of view. However, also Gold and/or Platinum can be used. The high-density layer can be the high density layer of the substrate membrane and/or the high-density layer of the cell membrane.

In another variant, the high-density layer comprises a plurality of adjacent trenches extending into the high-density layer in the direction orthogonal to the substrate sides. This relieves stress in the high-density layer and/or reduces acoustic coupling, in particular lateral acoustic coupling. The high-density layer can be the high density layer of the substrate membrane and/or the high-density layer of the cell membrane. The method of forming these adjacent trenches can in particular be the same as the method of forming the trenches of the substrate cavity. In this way the manufacturing can be provided in an easy manner, with less different technologies needed.

In a further embodiment, the connecting cavity is formed in the substrate base layer. In this way the substrate cavity is formed or located in a single layer, the substrate base layer.

In an alternative embodiment, the substrate further comprises a buried layer arranged on the substrate base layer, wherein the connecting cavity is formed in the buried layer. In this way the substrate cavity is formed or located in two separate layers. This may make the manufacturing easier. In particular, during manufacturing, the buried layer may be partly removed (e.g. by etching) to form the connecting cavity. Remainders of the buried layer may be present on the sides of the connecting cavity.

In another embodiment, the cMUT cell further comprises a top electrode as part of the cell membrane, and a bottom electrode used in conjunction with the top electrode. This provides a basic embodiment of a cMUT cell. For receiving ultrasound waves, ultrasound waves cause the cell membrane to move or vibrate and the variation in the capacitance between the top electrode and the bottom electrode can be detected. Thereby the ultrasound waves are transformed into a corresponding electrical signal. Conversely, for transmitting ultrasound waves, an electrical signal applied to the top electrode and the bottom electrode causes the cell membrane to move or vibrate and thereby transmit ultrasound waves.

In another embodiment, the device further comprises a plurality of cMUT cells each mounted to the substrate, wherein a substrate cavity is located in each region of the substrate underneath a cMUT cell. In particular, the cMUT cells can be arranged in an array. In this way the acoustic coupling of an array of cMUT cells to the substrate can be reduced.

In another embodiment, the plurality of adjacent trenches are formed using anisotropic etching. This provides an easy way of manufacturing.

In a further embodiment, the connecting cavity is formed using isotropic etching. This embodiment can in particular be used in connection with the previous embodiment. In this case, the etching can be changed from anisotropic etching to anisotropic etching.

In another aspect of the present invention a cMUT cell for transmitting and/or receiving ultrasound waves is presented, the cMUT cell comprising a cell membrane, a cavity underneath the cell membrane, a top electrode as part of the cell membrane, and a bottom electrode used in conjunction with the top electrode, wherein the cell membrane further comprises a high-density layer made of a high-density material.

The basic idea of this aspect of the invention is to provide a high-density layer on or as part of the cell membrane to improve the acoustic properties of the cMUT cell. The high-density layer can be tuned to improve the acoustic properties. In particular, the coupling of the sound waves to fluid or fluid-like substances (e.g. body or water) can be improved or tuned. The high-density layer is in particular a layer additional to the top electrode layer. Thus, the high-density layer does not (necessarily) act as the top electrode, but is in particular an additional layer on the outer side of the cMUT cell.

It shall be understood that the cMUT cell has similar and/or identical preferred embodiments as the claimed ultrasound transducer device and as defined in the dependent claims.

For example, in one embodiment, the high-density material is or comprises Tungsten, Gold or Platinum. Tungsten is a particularly suitable high-density material, also from a processing point of view. However, also Gold and/or Platinum can be used.

In another embodiment, the high-density layer comprises a plurality of adjacent trenches extending into the high-density layer. This relieves stress in the high-density layer.

BRIEF DESCRIPTION OF THE DRAWINGS

These and other aspects of the invention will be apparent from and elucidated with reference to the embodiment(s) described hereinafter. In the following drawings

DETAILED DESCRIPTION OF THE INVENTION

Figure 1A:
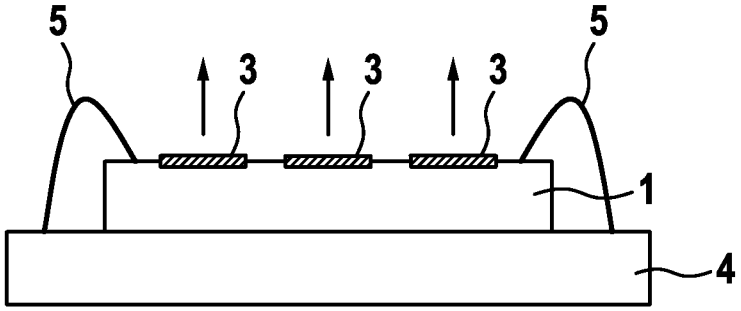
FIG. 1*a-c* show the three different solutions of a cMUT device connected to an ASIC.
Figure 1B:
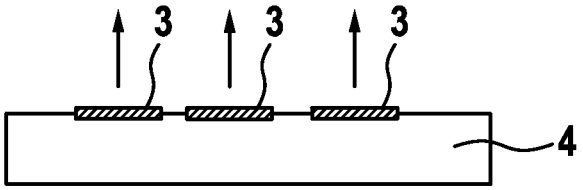
Figure 1C:
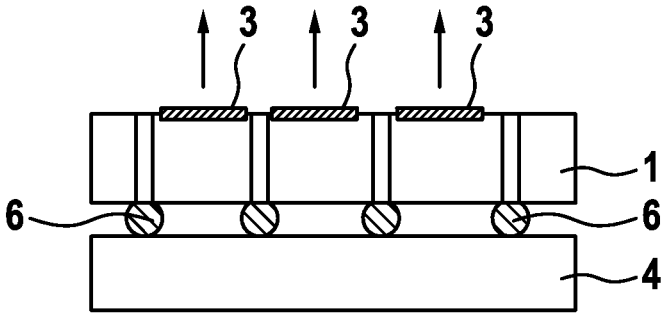
Figure 2:
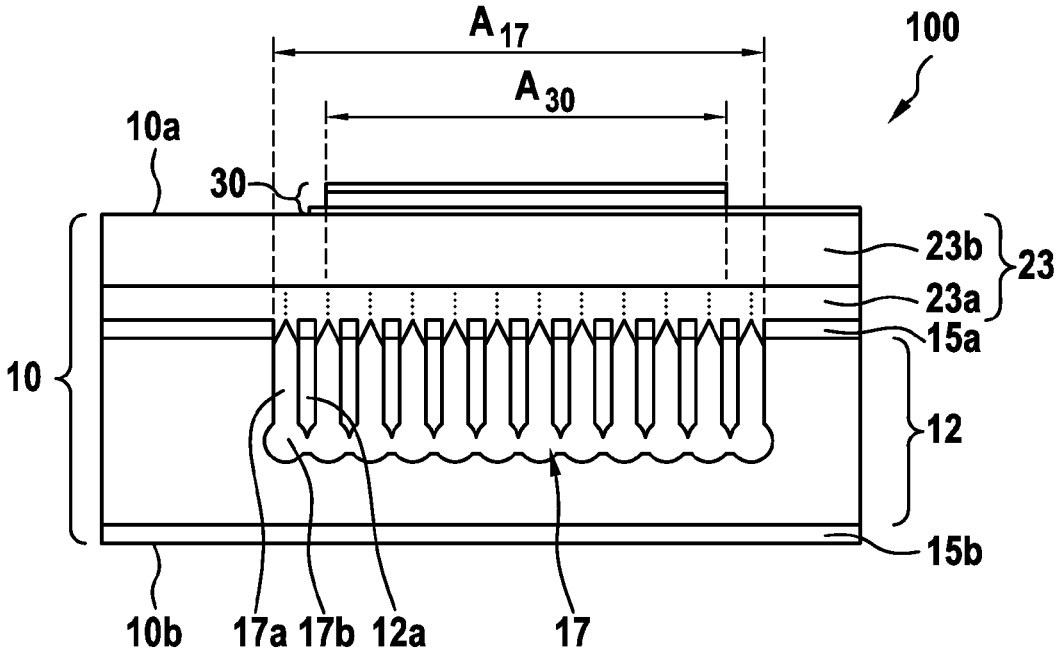
FIG. 2 shows a schematic cross-section of an ultrasound transducer device according to a first embodiment.

FIG. 2 shows a schematic cross-section of an ultrasound transducer device (or assembly) 100 according to a first embodiment. The ultrasound transducer device 100 comprises a cMUT cell 30 for transmitting and/or receiving ultrasound waves. Thus, the device 100 is a cMUT device. The cMUT cell 30 comprises a (flexible or movable) cell membrane and a cavity underneath the cell membrane.

Figure 2A:
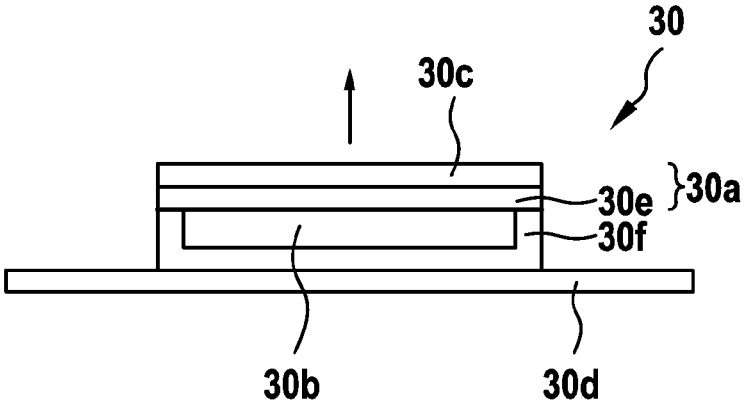
FIG. 2*a* a schematic cross-section of an exemplary cMUT cell.

FIG. 2*a* shows a schematic cross-section of an exemplary cMUT cell. The cMUT cell 30 comprises the cell membrane 30*a* and the cavity 30*b* (in particular a single cavity) underneath the cell membrane 30*a*. The cMUT cell 30 further comprises a top electrode 30*c* as part of the cell membrane 30*a*, and a bottom electrode 30*d* used in conjunction with the top electrode 30*c*. For receiving ultrasound waves, ultrasound waves cause the cell membrane 30*a* to move or vibrate and a variation in the capacitance between the top electrode 30*c* and the bottom electrode 30*d* can be detected. Thereby the ultrasound waves are transformed into a corresponding electrical signal. Conversely, for transmitting ultrasound waves, an electrical signal applied to the top electrode 30*c* and the bottom electrode 30*d* causes the cell membrane 30*a* to move or vibrate and thereby transmitting ultrasound waves.

In the embodiment of FIG. 2*a* the cell membrane 30*a* comprises a cell membrane base layer 30*e*. The top electrode 30*c* is attached to or arranged on the cell membrane base layer 30*e*. However, it will be understood that the top electrode 30*c* can also be integrated into the cell membrane base layer 30*e* (e.g. shown in FIG. 2*b* or FIG. 2*c*). The cMUT cell 30 further comprises a cell membrane support 30*f* on which the cell membrane 30*a* is arranged. The cavity 30*b* is formed in or within the cell membrane support 30*f*. The cell membrane support 30*f* is arranged on the bottom electrode 30*d*.

It will be understood that the cMUT cell of FIG. 2*a* is only an exemplary, basic cMUT cell. The cMUT cell 30 of the ultrasound transducer device 100 according to the present invention can comprise any suitable type of cMUT cell.

Figure 2B:
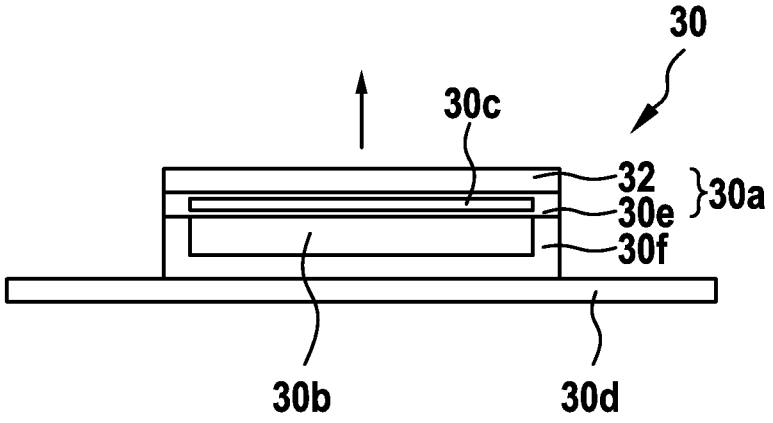
FIG. 2*b* shows a schematic cross-section of a cMUT cell according to an embodiment.

FIG. 2*b* shows a schematic cross-section of a cMUT cell 30 according to an embodiment. The cMUT cell 30 for transmitting and/or receiving ultrasound waves comprises a cell membrane 30*a*, a cavity 30*b* underneath the cell membrane 30*a*, a top electrode 30*c* as part of the cell membrane 30*a*, and a bottom electrode 30*d* used in conjunction with the top electrode 30*c*. The explanations of FIG. 2*a* also apply to this embodiment. Additionally, the cell membrane 30*a* comprises a high-density layer 32 made of a high-density material. The high-density layer 32 is arranged on the outer side of the cMUT cell 30, in particular the outer side in a direction corresponding to the general direction where the ultrasound waves are transmitted (indicated by an arrow). This high-density layer 32 improves the acoustic properties, in particular the coupling of the sound waves to fluid or fluid-like substances (e.g. body or water). Preferably, the high-density material is or comprises Tungsten. However, it will be understood that any other suitable high-density material can be used, such as for example Platinum or Gold.

Figure 2C:
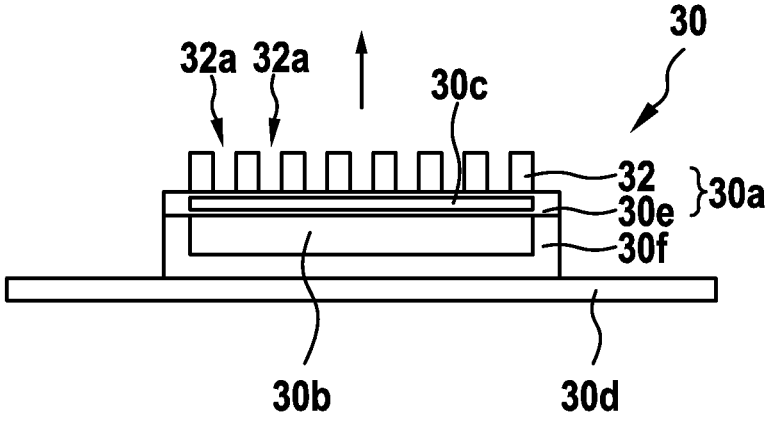
FIG. 2*c* shows a schematic cross-section of a cMUT cell according to another embodiment.

FIG. 2*c* shows a schematic cross-section of a cMUT cell 30 according to another embodiment. The embodiment of FIG. 2*c* is based on the embodiment of FIG. 2*b*. Additionally, the high-density layer 32 comprises a plurality of adjacent trenches 32*a* extending into the high-density layer 32. The trenches 32*a* extend in a direction corresponding to or opposite to the general direction where the ultrasound waves are transmitted (or a direction orthogonal to the sides of an underlying substrate). In other words the high-density layer 32 is patterned. These trenches 32*a* relieve stress in the high-density layer 32.

Now returning to FIG. 2, the ultrasound transducer device 100 further comprises a substrate 10 having a first side 10*a* or surface (here top side or surface) and a second side 10*b* or surface (here bottom side or surface). The cMUT cell 30 is arranged or fabricated on the first substrate side 10*a*. The first (top) side 10*a* (or first surface) faces the cMUT cell 30 and the second (bottom) side 10*b* (or second surface) faces away from the cMUT cell 30. As can be seen in FIG. 2, the substrate 10 comprises a substrate base layer 12. If the substrate base layer 12 is made of a conductive material (e.g. Silicone), the substrate layer 12 may comprise a non-conductive layer 15*a*, 15*b* (e.g. made of oxide or oxidized substrate base layer material) on each side, as indicated in FIG. 2. The substrate 10 further comprises a plurality of adjacent trenches 17*a* extending into the substrate base layer 12 in a direction orthogonal to the substrate sides 10*a*, 10*b* (vertical in FIG. 2). In this way spacers 12*a* (made of the substrate base layer material) are each formed between adjacent trenches 17*a*. The spacers 12*a* remain suspended to the substrate base layer 12 at an edge or side of the trenches 17*a* (not visible in the cross-section of FIG. 2). The substrate 10 further comprises a connecting cavity 17*b* which connects the trenches 17*a* and which extends in a direction parallel to the substrate sides 10*a*, 10*b* (horizontal or lateral in FIG. 2). The trenches 17*a* and the connecting cavity 17*b* together form a substrate cavity 17 in the substrate 10. The spacers 12*a* extend into the substrate cavity 17 (in a direction orthogonal to the substrate sides 10*a*, 10*b*. The substrate 10 further comprises a substrate membrane 23 covering the substrate cavity 17. In this way a "floating" membrane is provided in the substrate 10 (or substrate base layer 12) underneath the cMUT cell 30. The membrane 23 may comprise a single membrane layer. Alternatively, the membrane 23 may comprise multiple membrane layers. In the embodiment of FIG. 2, two membrane layers 23*a*, 23*b* are illustrated as an example. However, it will be understood that the membrane 23 can comprise any suitable number of membrane layers.

The substrate cavity 17 is located in a region $A_{30}$ of the substrate 10 (or substrate base layer 12) underneath the cMUT cell 30. In other words this is the region of the substrate 10 vertically underneath the cMUT cell 30*a*. In particular, the substrate cavity 17 is located in at least the entire region $A_{30}$ of the substrate underneath the cell membrane 30*a* of the cMUT cell. As can be seen in the embodiment of FIG. 2, the substrate cavity is located in a region $A_{17}$ of the substrate 10 which even extends beyond (or is bigger than) the region $A_{30}$ of the substrate where the cell membrane 30*a* of the cMUT cell 30 is located.

In the embodiment of FIG. 2, the connecting cavity 17*b* is formed or located in the substrate base layer 12. Thus, the substrate cavity 17 is essentially located in the substrate base layer 12. Therefore, in this embodiment the substrate cavity 17 is formed or located in a single layer. In the embodiment of FIG. 2, the substrate cavity 17 is fully closed or sealed. The substrate cavity 17 can for example have a pressure below the atmospheric pressure, e.g. of 10 mBar or less and/or of 3 mBar and more (in particular between 3 mBar and 10 mBar). The substrate membrane 23 can for example comprise a membrane layer (e.g. oxide layer) 23*a* arranged over the substrate cavity 17 (or trenches 17*a*), as illustrated in FIG. 2. By providing a non-conformally deposited layer, such as an oxide layer, the substrate cavity 17 (or trenches 17) can be easily covered or sealed. However, it will be understood that any other suitable material for such membrane layer can be used (e.g. nitride).

FIG. 3*a-e* each shows a schematic cross-section of the ultrasound transducer device of the first embodiment of FIG. 2 in a different manufacturing stage. The method of manufacturing an ultrasound transducer device comprises first the step of providing a substrate having a first side and a second side and having a substrate base layer 12 (see FIG. 3*a*). Subsequently, a plurality of adjacent trenches 17*a* are formed which extend into the substrate base layer 12 in a direction orthogonal to the substrate sides (see FIG. 3*b*). In this way, spacers 12*a* are each formed between adjacent trenches 17*a*. For example, the plurality of adjacent trenches 17*a* can be formed using anisotropic etching (e.g. anisotropic RIE etching). In this embodiment, the trenches 17*a* are formed or etched from the first substrate side 10*a*.

Figure 3A:
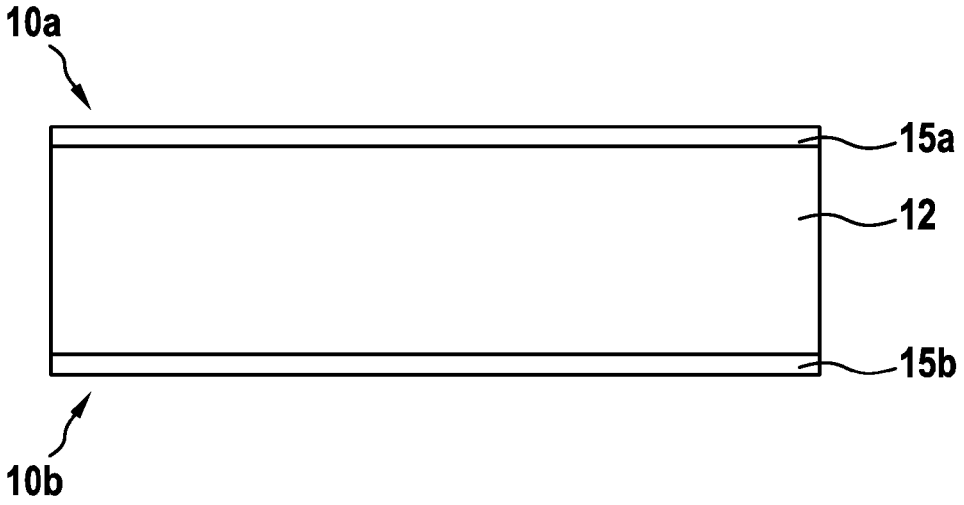
FIG. 3*a-e* each shows a schematic cross-section of the ultrasound transducer device of the first embodiment of FIG. 2 in a different manufacturing stage.
Figure 3B:
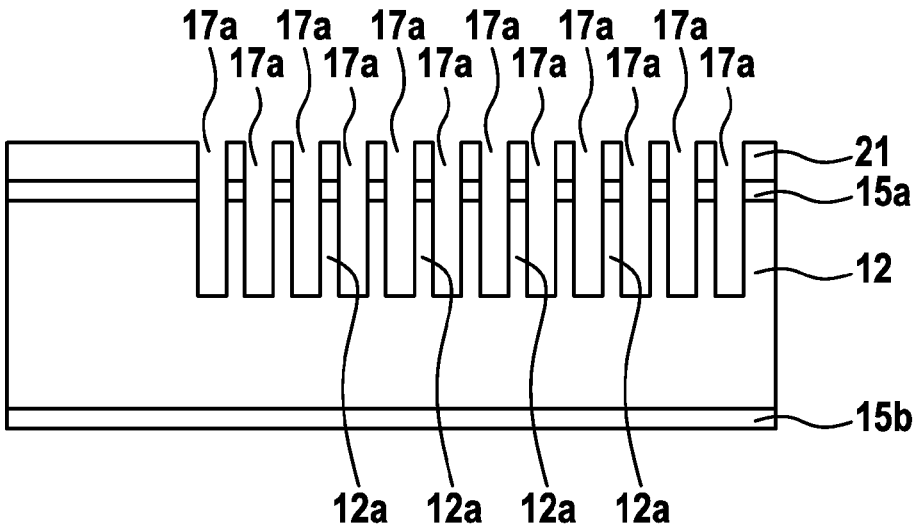
Figure 3C:
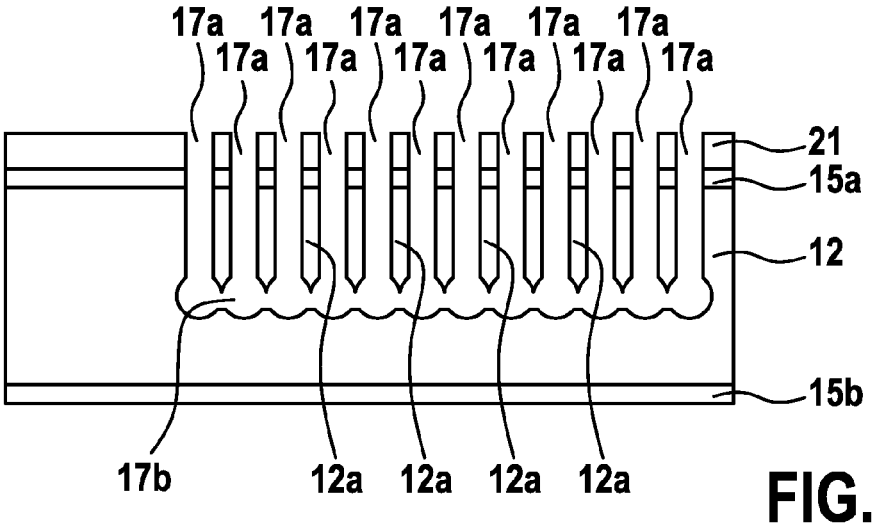
Figure 3D:
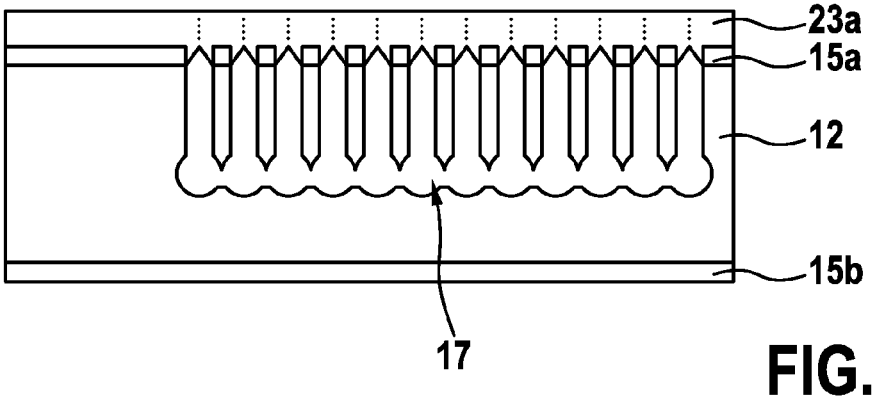

The method further comprises forming a connecting cavity 17*b* which connects the trenches 17*a* and which extends in a direction parallel to the substrate sides (see FIG. 3*c*). In this embodiment, the connecting cavity 17*b* is also formed in the substrate base layer 12 where the trenches 17*a* have been formed. The trenches 17*a* and the connecting cavity 17*b* together form a substrate cavity 17 into which the spacers 12*a* extend. The substrate cavity 17 is essentially located in the substrate base layer 12. For example, the connecting cavity 17*b* can be formed using isotropic etching (e.g. isotropic RIE etching). In particular, the etching can be changed from anisotropic etching (e.g. RIE) to isotropic etching (e.g. by omitting the passivation cycle in the etching process). In this way, the trenches 17*a* are "under-etched", leaving the spacers 12*a* suspended to the edge of the substrate cavity 17. Thus, the connecting cavity 17*b* is an "under-etched" portion.

The method further comprises arranging a substrate membrane 23 covering the substrate cavity 17. In this embodiment, first a non-conformally deposited layer 23*a* (of the membrane 23), such as an oxide layer, is arranged over or on the substrate cavity 17 or the trenches 17*a* (see FIG. 3*d*). In this way the trenches 17*a* are closed so that a planar surface allowing further planar processing can be obtained. Optionally, one or more additional layer(s) 23*b* (of the membrane 23) can be applied. The additional layer 23*b* can for example be a high-density layer as will be explained in more detail with reference to FIG. 4.

Figure 9:
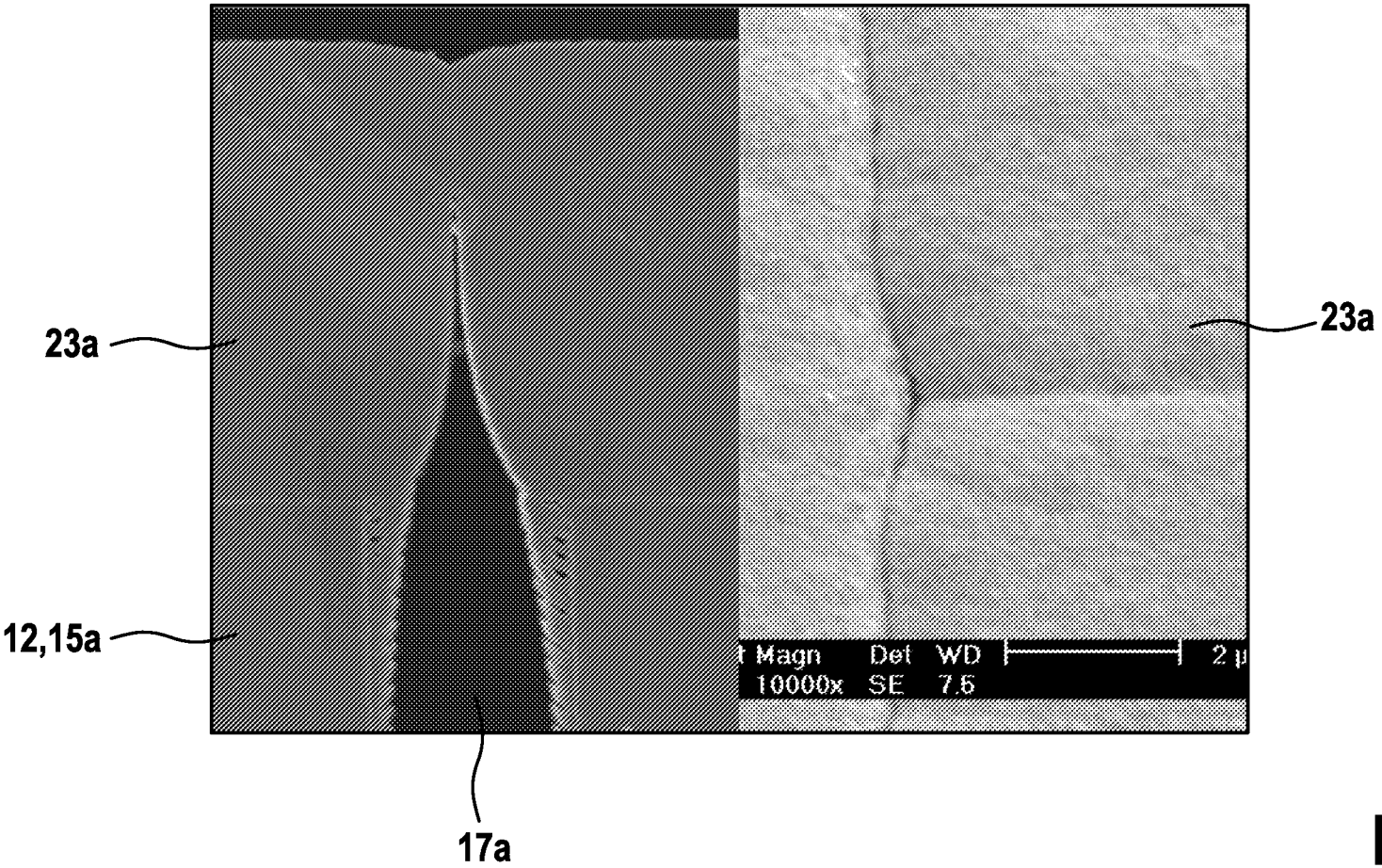
FIG. 9 shows a cross-section and a top-view of part of the substrate of the ultrasound transducer device according to an embodiment.

As an example, FIG. 9 shows a cross-section (left picture) and a top-view (right picture) of part of the substrate 10 of the ultrasound transducer device 100 according to an embodiment, in particular the embodiment of FIG. 2 and FIG. 3. In the cross-section (left picture of FIG. 9) the substrate base layer 12 (or layer 15*a*) with a non-conformally deposited layer 23*a*, such as an oxide layer, on top is shown. The trench 17*a* is formed in the substrate base layer 12 (or layer 15*a*). As can be seen in the cross-section (left picture of FIG. 9) the trench 17*a* comprises a tapered portion at its top part which extends into the non-conformally deposited layer 23*a* (e.g. oxide layer). Above this tapered portion the non-conformally deposited layer 23*a* (e.g. oxide layer) seals the trench 17*a* or substrate cavity.

Figure 3E:
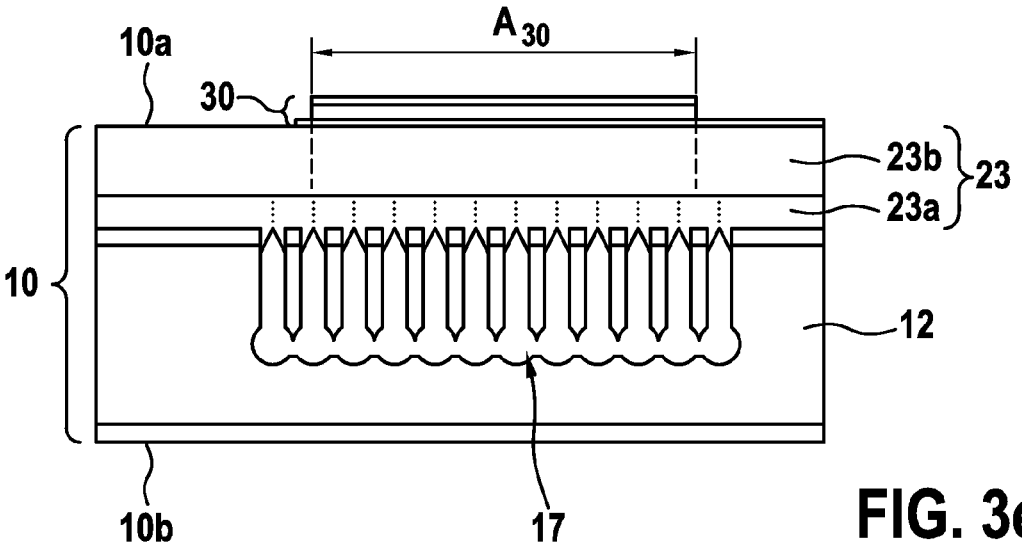

In a subsequent and final step of the method, the cMUT cell 30 is arranged or fabricated on the first substrate side 10*a* (see FIG. 3*e*). The substrate cavity 17 is located in a region $A_{30}$ of the substrate 10 underneath the cMUT cell 30. In other words, the cMUT cell 30 is arranged or fabricated on the first substrate side 10*a* in the region $A_{30}$ where the substrate cavity 17 is located (or vertically above the substrate cavity 17).

Figure 4:
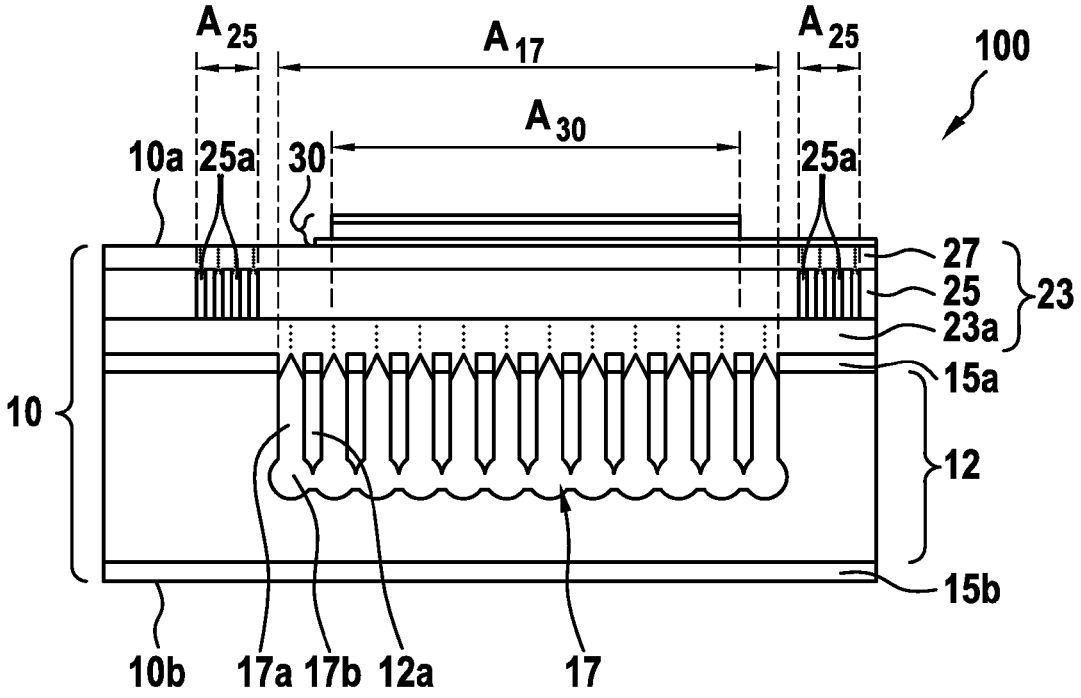
FIG. 4 shows a schematic cross-section of an ultrasound transducer device according to a second embodiment.

FIG. 4 shows a schematic cross-section of an ultrasound transducer device 100 according to a second embodiment. As the second embodiment of FIG. 4 is based on the first embodiment of FIG. 2, the same explanations as to the previous Figures also apply to this second embodiment of FIG. 4. In the second embodiment of FIG. 4 the membrane 23 further comprises a high-density layer 25 made of a high-density material. In this embodiment the high-density layer 25 is arranged on the non-conformally deposited layer 23*a* (e.g. oxide layer). Preferably, the high-density material is or comprises Tungsten. However, it will be understood that any other suitable high-density material can be used such as for example Platinum or Gold. The high-density layer 25 or membrane 23 has a mass (e.g. by providing a suitable thickness) which is sufficient or sufficiently large to provide an inertial force which substantially opposes the acoustic pressure force developed by the cMUT cell 30 during transmission of the ultrasound waves. Further, the thickness of the high-density layer 25 or membrane 23 is sufficient or sufficiently small so as to not cause undesired reflections of the ultrasound waves. Optionally, the high-density layer 25 comprises a plurality of adjacent trenches 25*a* extending into the high-density layer 25 in the direction orthogonal to the substrate sides 10*a*, 10*b*. This relieves stress in the high-density layer 25 and reduces (lateral) acoustic coupling. The trenches 25*a* are arranged in a region $A_{25}$ outside (or not intersecting with) the region $A_{30}$ of the substrate 10 directly underneath the cMUT cell 30. However, it will be understood that the trenches 25*a* can also be arranged in any other region, such as for example the region $A_{30}$ underneath the cMUT cell 30. Optionally, as indicated in FIG. 4, an additional layer 27 (e.g. made of oxide) can be arranged on the high-density layer 25, in particular covering the trenches 25*a*. It will be understood that that the cMUT cell 30 of FIG. 4 can be any suitable type of cMUT cell, in particular the cMUT cell of FIG. 2*a*, FIG. 2*b*, or FIG. 2*c* as explained above.

Figure 5:
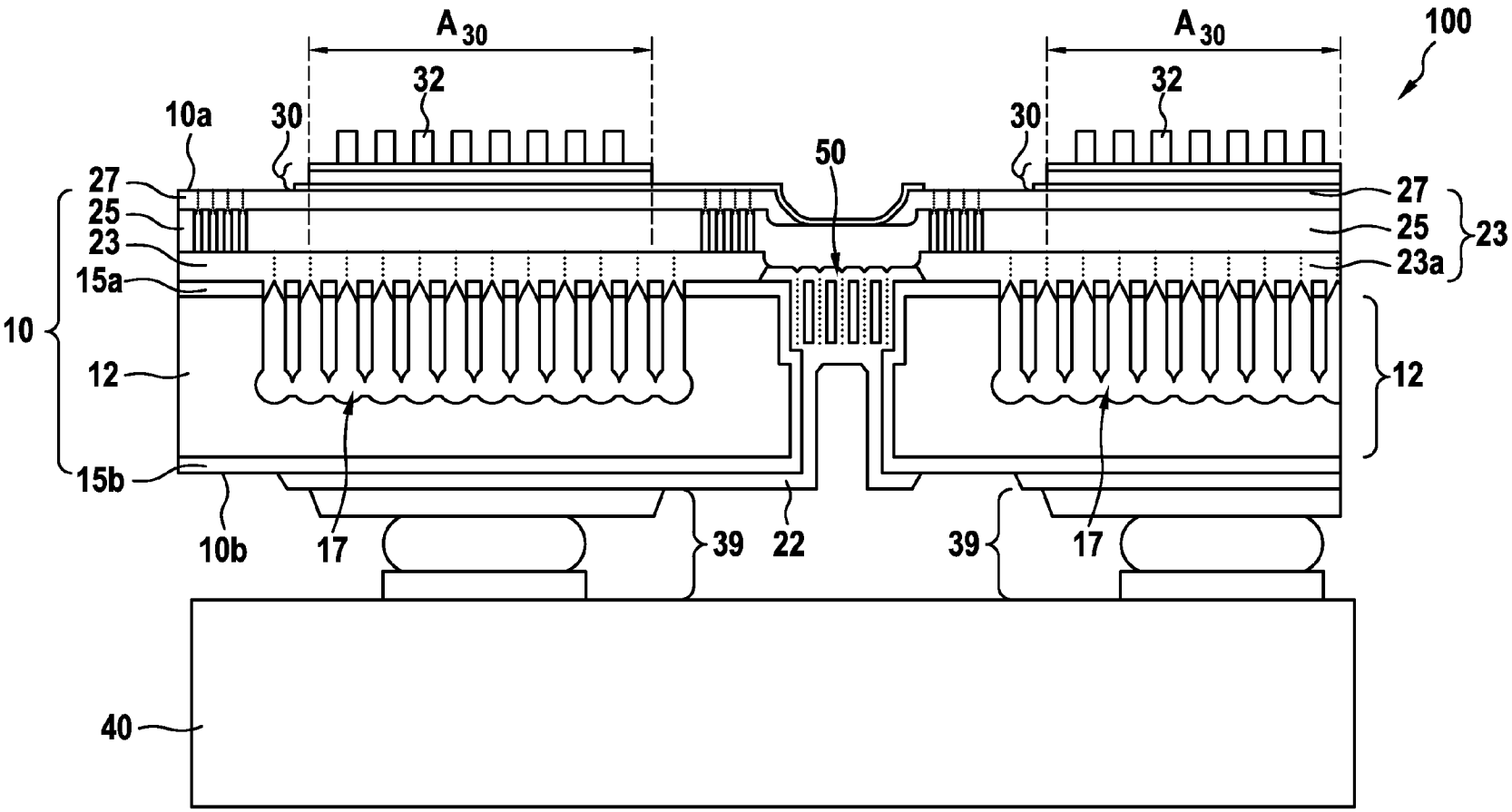
FIG. 5 shows a schematic cross-section of an ultrasound transducer device according to a third embodiment.

FIG. 5 shows a schematic cross-section of an ultrasound transducer device according to a third embodiment. As the third embodiment of FIG. 5 is based on the second embodiment of FIG. 4, the same explanation as to the previous FIGS. 2 to 4 also apply to this third embodiment of FIG. 5. Compared to the previous embodiments, the device 100 comprises a plurality of cMUT cells 30 each mounted to the substrate 10. In this way the cMUT cells 30 can be arranged in an array. A substrate cavity 17 is located in each region $A_{30}$ of the substrate underneath a cMUT cell 30 In FIG. 5 only two cMUT cells 30 are shown for simplification purposes. However, it will be understood that any suitable number of cMUT cells can be used. Also, in FIG. 5, the cMUT cell 30 is the cMUT cell of the embodiment of FIG. 2*c* described above. Thus, a patterned high-density layer 32 is arranged on the cMUT cell 30. This improves acoustic properties. However, it will be understood that any other type of suitable cMUT cell can be used.

In FIG. 5 is a "hybrid" device (two chips) is shown which comprises the ultrasound transducer device 100 and an ASIC 40. The substrate 10 or ultrasound transducer device (cMUT device) 100 is "flip-chipped" on the ASIC 40. In FIG. 5 an electrical connection in form of solder bumps 39 is used to arrange the ultrasound transducer device 100 on the ASIC 40. The substrate 10 further comprises a through-wafer via 50 to provide an electrical connection from the first substrate side 10*a* to the second substrate side 10*b*. In this way, the cMUT cell(s) 30 on the first substrate side 10*a* can be electrically connected to the second substrate side 10*b*. In particular, the through-wafer via 50 comprises a conductive layer 22 which provides the electrical connection through the substrate 10.

FIG. 6*a-j* each shows a cross-section of an ultrasound transducer device according to the second embodiment of FIG. 4 or the third embodiment of FIG. 5 in a different manufacturing stage. First, referring to FIG. 6*a*, a resist 21 is applied on the first wafer side 10*a*, and then the plurality of adjacent trenches 17*a* are formed or etched (e.g. using deep RIE etching) from the first substrate side 10*a* into the substrate base layer 12. Spacers 12*a* are each formed between adjacent trenches 17*a*. Just as an example, the trenches 17*a* can each have a width of approximately 1.5 to 2 μm and/or the spacers 12*a* can each have a width of 1.5 to 2 μm, but are not limited thereto. Then, referring to FIG. 6*b*, the connecting cavity 17*b* is formed or etched in the substrate 10 or substrate base layer 12. The connecting cavity 17*b* is or forms an "under-etched" portion which connects the trenches 17*a*. The connecting cavity 17*b* can for example be formed by changing from anisotropic etching (e.g. RIE) to isotropic etching. For example, after the trenches 17*a* have reached their final depth, the passivation cycle in the etching process can be omitted so that etching continues in an isotropic mode. This will "under-etch" the trenches 17*a*, leaving the grid of side by side spacers 12*a* suspended on the sidewalls of the substrate cavity 17. The resist 21 is then removed.

Figure 6A:
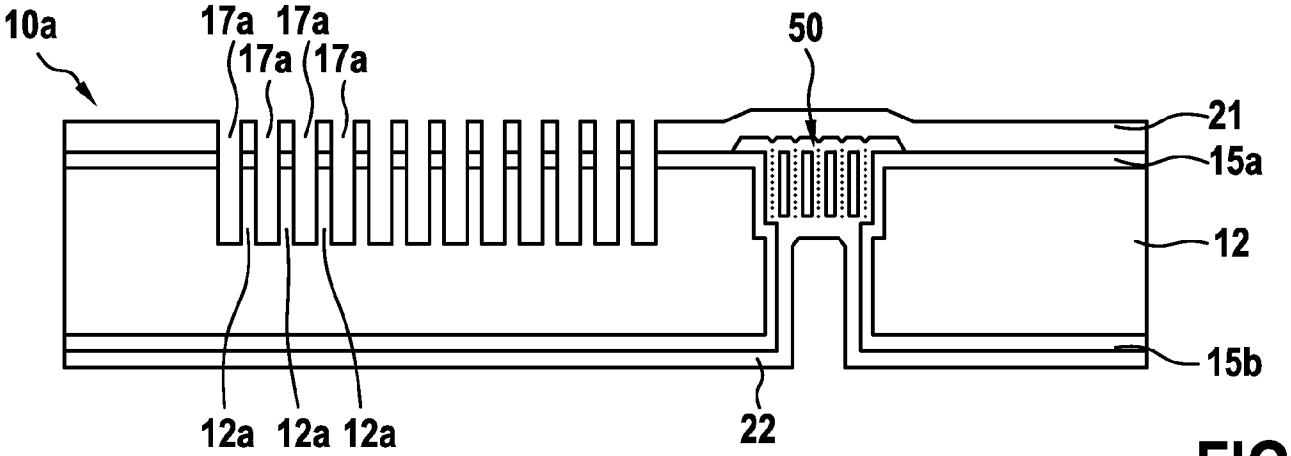
FIG. 6*a-j* each shows a cross-section of an ultrasound transducer device according to the second embodiment of FIG. 4 or the third embodiment of FIG. 5 in a different manufacturing stage.
Figure 6B:
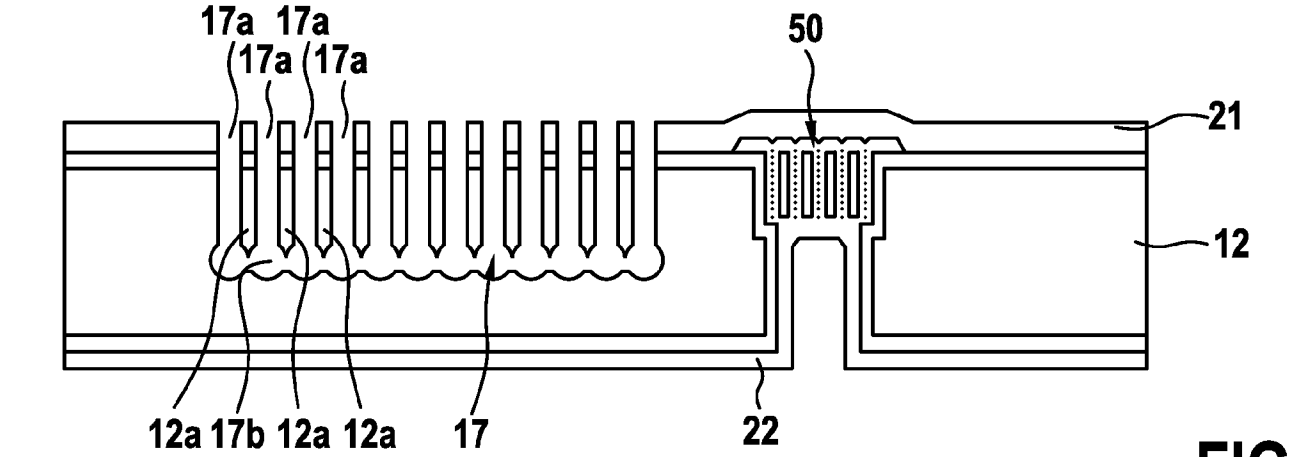
Figure 6C:
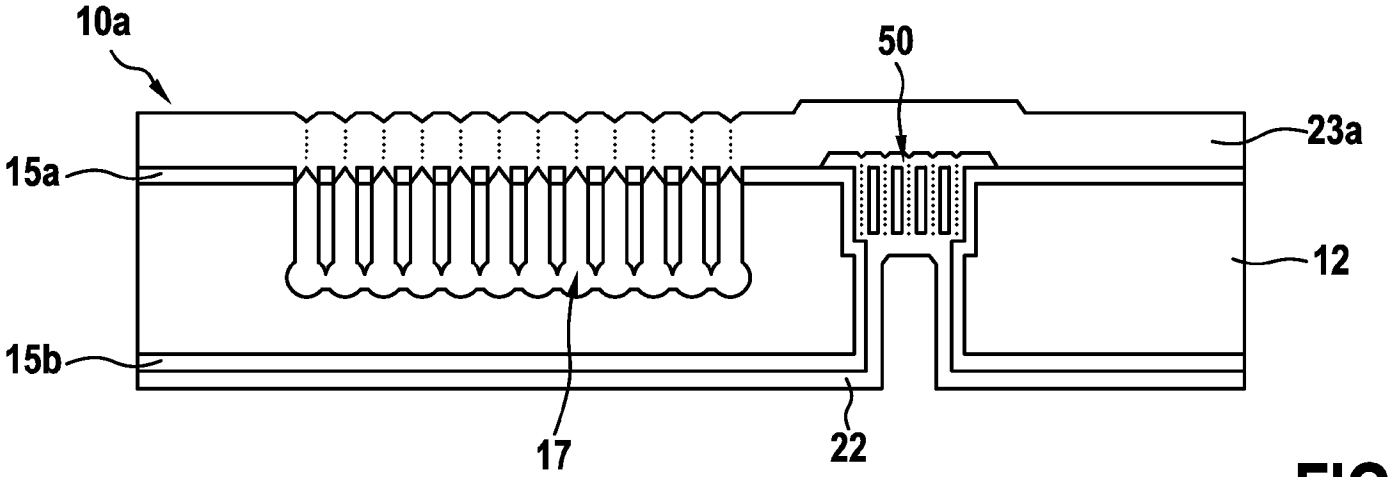
Figure 6D:
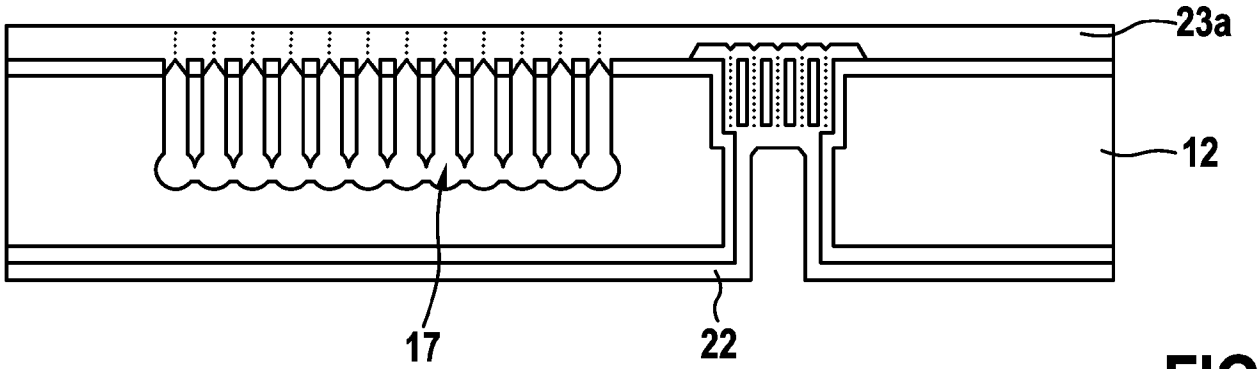
Figure 6E:
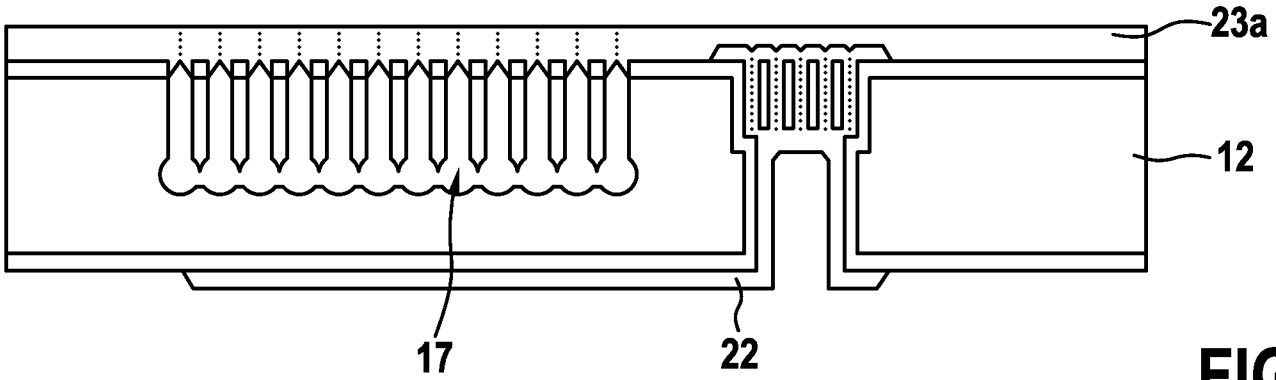
Figure 6F:
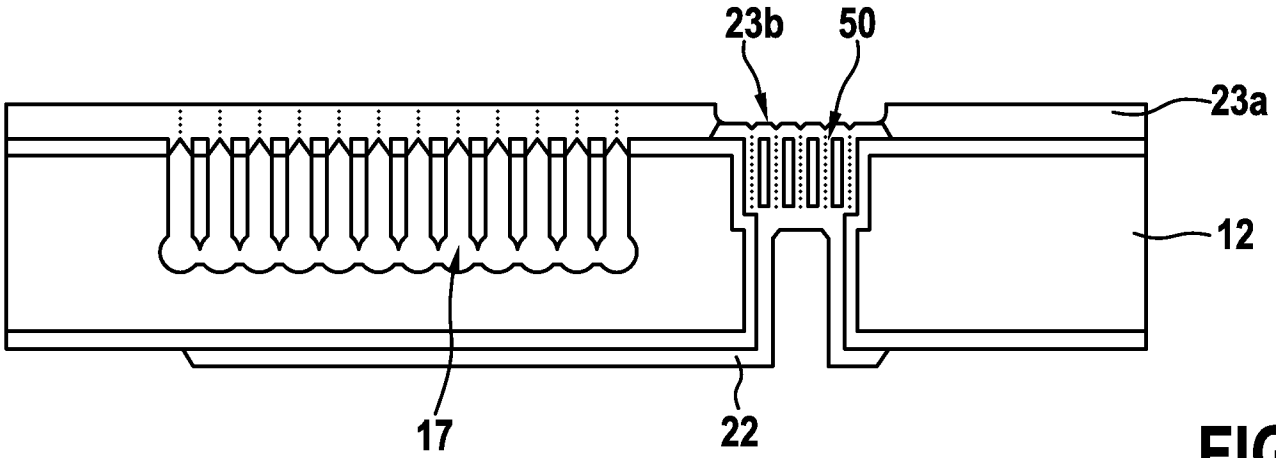

Subsequently, as shown in FIG. 6*c*, a substrate membrane layer 23*a* (in particular made of oxide) is applied (or deposited) such that it covers the substrate cavity 17. The substrate membrane layer 23*a* can for example be the non-conformally deposited layer. In particular, the substrate membrane layer 23*a* can be applied onto the (first side of the) substrate base layer 12, or the layer 15*a*. In this way the substrate cavity 17 (in particular trenches 17*a*) is sealed by the substrate membrane layer 23*a*. For example, the membrane layer (or oxide layer) 23*a* can be applied using PECVD. Just as an example, the thickness of the membrane layer (or oxide layer) 23*a* can be between 1 μm to 20 μm, in particular between about 4 μm to 6 μm, but is not limited thereto. The pressure inside the substrate cavity 17 can for example be in the order of 3 to 10 mbar (e.g. as set by the conditions in the PECVD reaction chamber). As can be seen in FIG. 6*d*, optionally substrate membrane layer 23*a* can then be planarized, for example using a short Chemical Mechanical Polish (CMP), to prepare the substrate for the fabrication of the cMUT cells. At this stage, referring to FIG. 6*e*, optionally also the conductive layer 22 can be patterned. Referring to FIG. 6*f*, optionally a hole 23*b* can be etched through the substrate membrane layer 23*a* to access the through-wafer via 50 for providing an electrical connection.

Figure 6G:
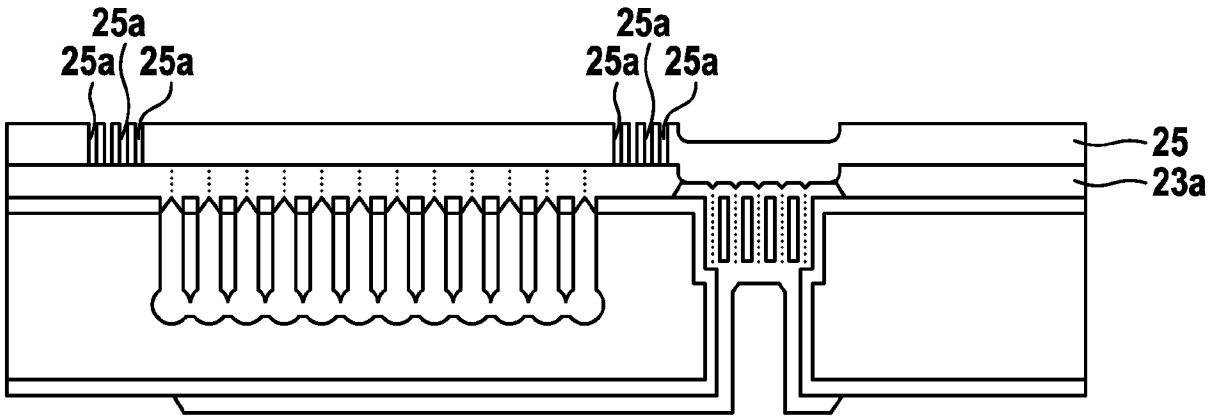
Figure 6H:
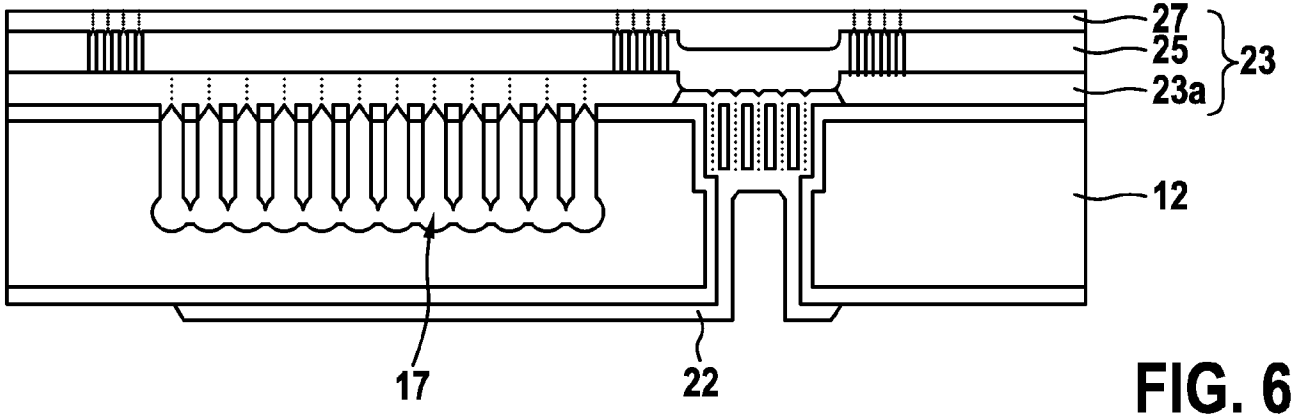

Then, as shown in FIG. 6*g*, a high-density layer 25 (e.g. made of Tungsten) is provided on the substrate membrane layer (or oxide layer) 23*a*. Just as an example, the high-density layer 25 can have a thickness of about 3 μm to 5 μm, but is not limited thereto. The high-density layer 25 is thin enough so as not to cause undesired reflections, but heavy enough to provide enough inertia for the moving cMUT cell. The fabrication of the high-density layer 25 can for example closely resemble the fabrication of the membrane 23. After the deposition of the high-density layer 25, optionally trenches 25*a* can be etched into the high-density layer 25 (e.g. by RIE etching). In this way the high-density layer 25 can be divided into small islands. This relieves the stress in the high-density layer 25 as well as reduces lateral acoustic coupling. As shown in FIG. 6*h*, the trenches 25*a* in the high-density layer 25 are sealed using an additional layer 27 (e.g. using PECVD), for example made of oxide (e.g. silicone oxide), which is then planarized (e.g. using CMP). Thus, in this embodiment the membrane 23 comprises the membrane (oxide) layer 23*a*, the high-density layer 25 and the additional (oxide) layer 27.

Figure 6I:
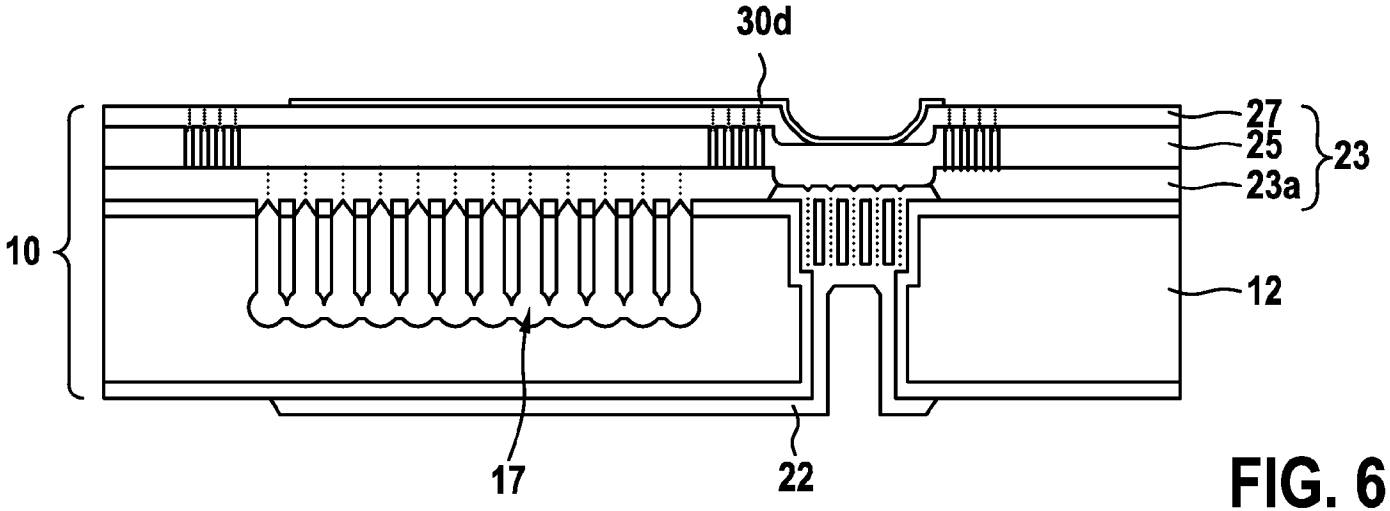
Figure 6J:
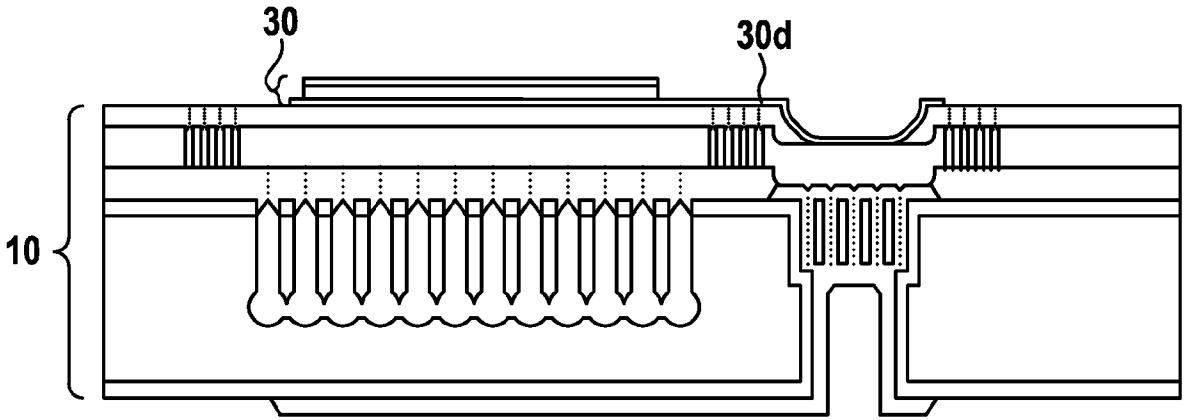

Then, the processing of the cMUT cell 30 starts. As shown in FIG. 6*i*, a bottom electrode 30*d* is applied on the substrate 10, in particular on the additional oxide layer 27. Referring to FIG. 6*j*, the remaining part of the cMUT cell 30 is provided, in particular the cavity 30*b*, the membrane 30*a*, and the top electrode 30*c*, as explained with reference to FIG. 2*a*. Optionally (not shown), the high-density layer 32 (e.g. made of Tungsten) can then be arranged or deposited on the cMUT cell 30, in particular on the top electrode 30*c* or the cell membrane base layer 30*e*. The high-density layer 32 may optionally then be patterned to relieve the stress in this layer. In a final step, the electrical connection 39 (e.g. solder bumps) between the conductive layer 22 and an ASIC can then be provided and the ultrasound transducer device (cMUT device) 100 can then be "flip-chipped" on the ASIC, as explained with reference to FIG. 5.

Even though in the previous embodiment(s) a "hybrid" device (two chips) has been used, the ultrasound transducer device can also be implemented as a "monolithic" device (one chip) where the cMUT cells are fabricated directly on top of the ASIC. FIG. 7*a-d* each shows a cross-section of an ultrasound transducer device according to a fourth embodiment in a different manufacturing stage.

Figure 7A:
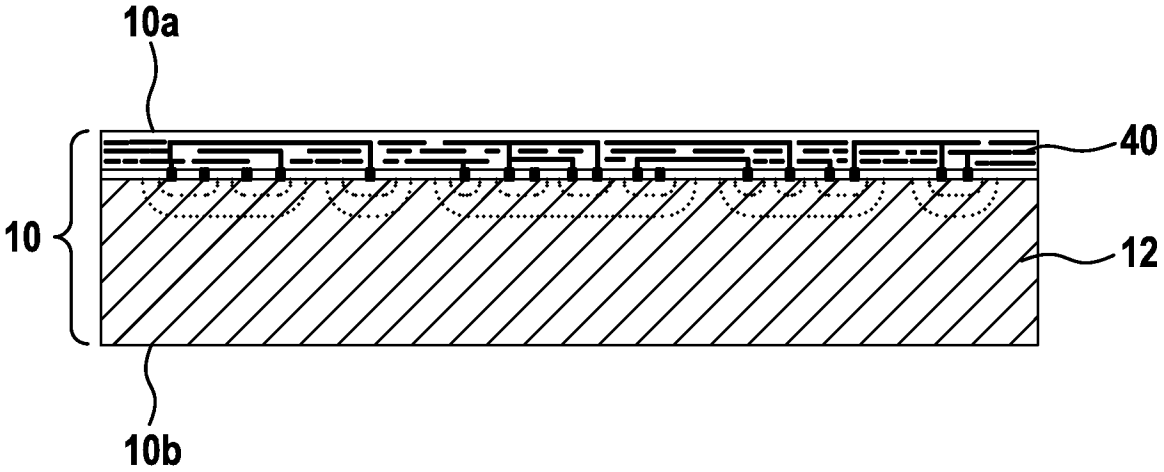
FIG. 7*a-d* each shows a cross-section of an ultrasound transducer device according to a fourth embodiment in a different manufacturing stage.
Figure 7B:
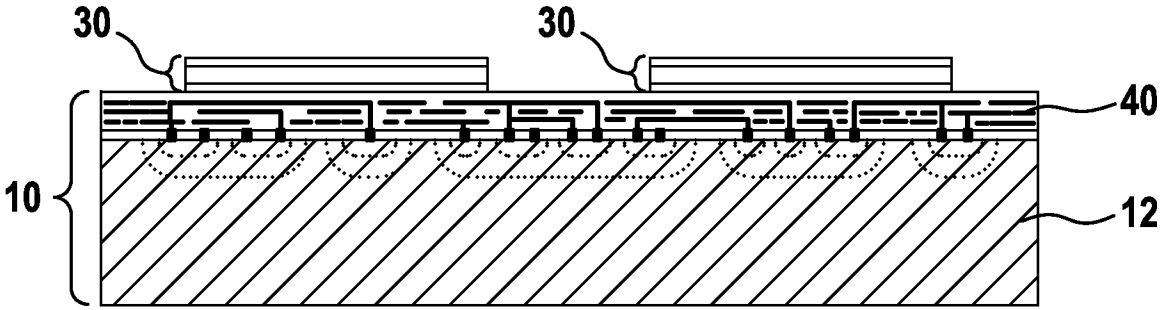

As can be seen in FIG. 7*a*, first a substrate 10, having a first side 10*a* and a second side 10*b* and having a substrate base layer 12, is provided. The substrate 10 is formed by a combination of the substrate base layer 12 with an ASIC 40 on top. Then, as shown in FIG. 7*b*, at least one cMUT cell 30 is arranged or fabricated on the first side 10*a* of the substrate 12 (substrate base layer 12 with the ASIC 40). The cMUT cells 30 are manufactured directly on the ASIC 40. Thus, this embodiment starts with a fully processed ASIC wafer (combination of substrate base layer 12 and ASIC 40) and the cMUT cells 30 are processed on top of this ASIC.

Figure 7C:
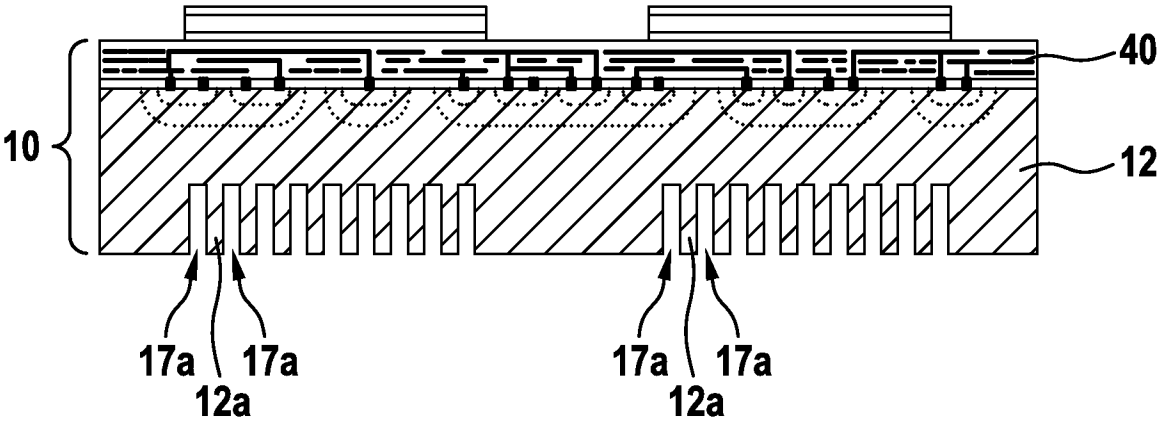

Subsequently, as indicated in FIG. 7*c*, the plurality of adjacent trenches 17*a* extending into the substrate base layer 12 in a direction orthogonal to the substrate sides 10*a*, 10*b* are formed or etched. Spacers 12*a* are each formed between adjacent trenches 17*a* . The trenches 17*a* form an array or grid of trenches. In this embodiment, the trenches 17*a* are formed or etched from the second substrate side 10*b*. The trenches 17*a* can be formed or etched using anisotropic etching. In this way the substrate 10 can be thinned down. For example, the substrate material above the trenches 17*a* can then be between 300 to 400 μm, but is not limited thereto. Then, referring to FIG. 7*d*, a connecting cavity 17*b* is formed in the substrate 10 or substrate base layer 12 which connects the trenches 17*a* and which extends in a direction parallel to the substrate sides 10*a*, 10*b*. This can for example be achieved by switching off, at the end of etching, the passivation cycle to continue etching isotropically, as explained with reference to the previous embodiments. Thus, the connecting cavity 17*b* can be formed using isotropic etching. The trenches 17*a* and the connecting cavity 17*b* together form a substrate cavity 17 in the substrate 10. The spacers 12*a* extend into the substrate cavity 17. In this embodiment, by forming the substrate cavity 17, inherently also a substrate membrane 23 covering the substrate cavity 17 is formed. The substrate membrane 23 is part of the substrate base layer 12 in this case. Thus, it is possible to form the membrane 23 by switching from anisotropic etching to isotropic etching. In this way the "floating" membrane is formed. A substrate cavity 17 is located in each region $A_{30}$ of the substrate 10 where the cMUT cell 30 is mounted. It is pointed out that not one big hole is etched for thinning the substrate 10, but a substrate cavity 17 having a very specific shape is etched, which provides the final device with a better mechanical integrity since the substrate cavity 17 is filled with a grid of spacers 12*a* (made of the substrate base layer material).

Figure 7D:
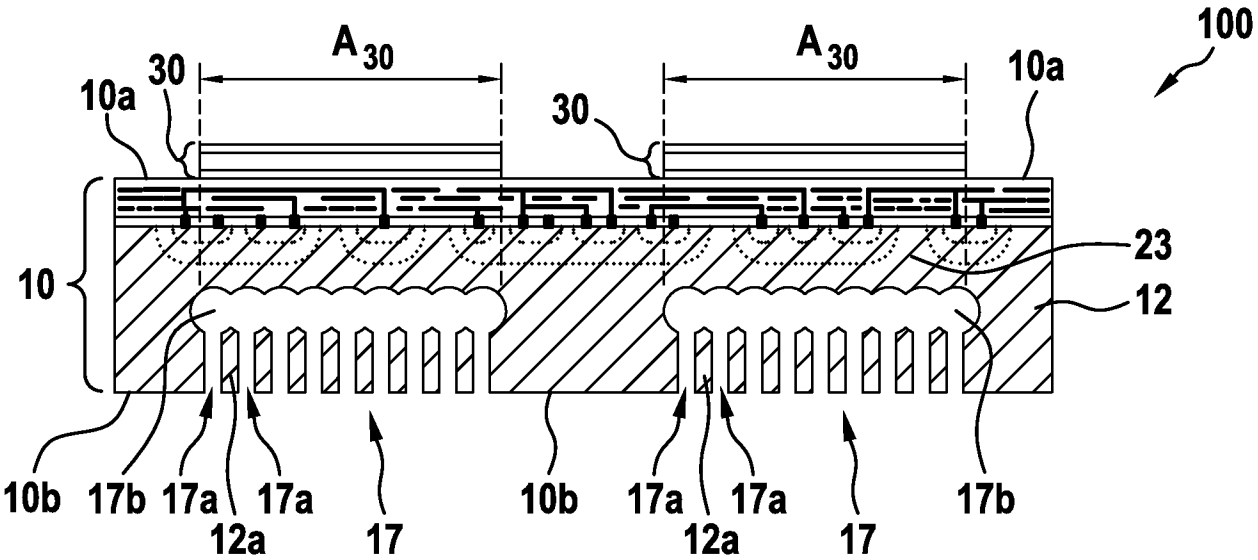

FIG. 7*d* shows the final ultrasound transducer device 100 of this fourth embodiment. The ultrasound transducer device 100 comprises the at least one cMUT cell 30, as previously explained, and the substrate 10 (substrate base layer 12 with the ASIC 40) having the first side 10*a* and a second side 10*b*. The at least one cMUT cell 30 is arranged on the first side 10*a* of the substrate 10. The substrate 10 comprises the substrate base layer 12, and the plurality of adjacent trenches 17*a* extending into the substrate base layer 12 in a direction orthogonal to the substrate sides 10*a*, 10*b*. The spacers 12*a* (of the substrate base layer material) are each formed between adjacent trenches 17*a*. The substrate 10 further comprises the connecting cavity 17*b* which connects the trenches 17*a* and which extends in a direction parallel to the substrate sides 10*a*, 10*b*. The trenches 17*a* and the connecting cavity 17*b* together form the substrate cavity 17 in the substrate 10. The substrate 10 further comprises the substrate membrane 23 covering the substrate cavity 17, which is part of the substrate base layer 12 in this embodiment. The substrate cavity 17 is located in a region $A_{30}$ of the substrate 10 underneath the cMUT cell 30.

In the fourth embodiment of FIG. 7*d*, the connecting cavity 17*b* is formed or located in the substrate base layer 12, in particular above or over the trenches 17*a*. Thus, the substrate cavity 17 is located in the substrate base layer 12. Therefore, in this fourth embodiment the substrate cavity 17 is formed or located in a single layer. In the fourth embodiment of FIG. 7*d*, the substrate cavity 17 is not fully closed or sealed, because the trenches 17*a* are open to the second substrate side 10*b*. Optionally, the membrane may further comprise a high-density layer, as explained with reference to FIG. 3 to FIG. 6. For example, the high-density layer may be arranged or applied on the ASIC 40 (e.g. prior to the fabrication of the cMUT cell) to provide a high-inertia substrate 10.

Figure 8A:
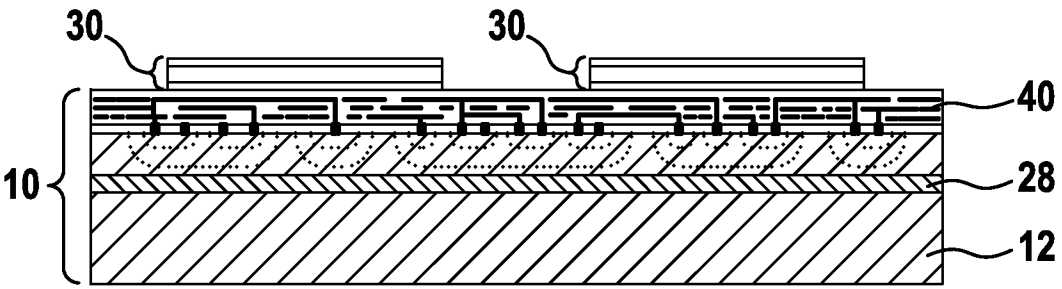
FIG. 8*a-c* each shows a cross-section of an ultrasound transducer device according to a fifth embodiment in a different manufacturing stage.
Figure 8B:
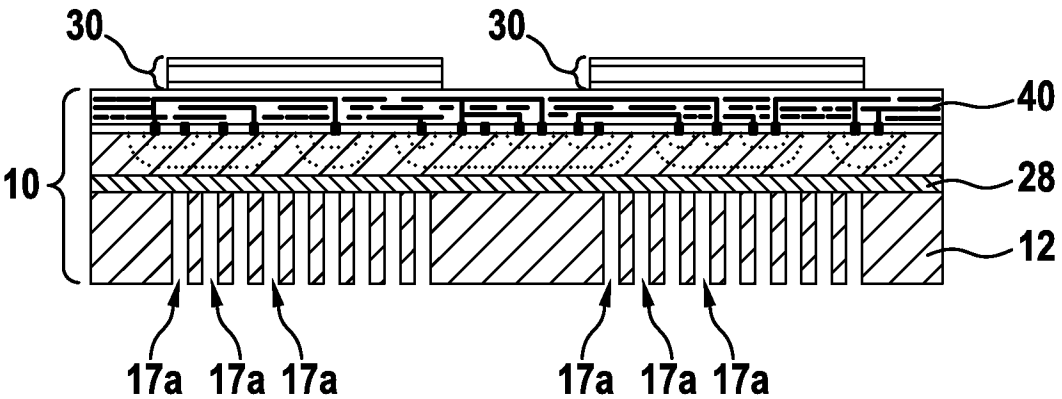
Figure 8C:
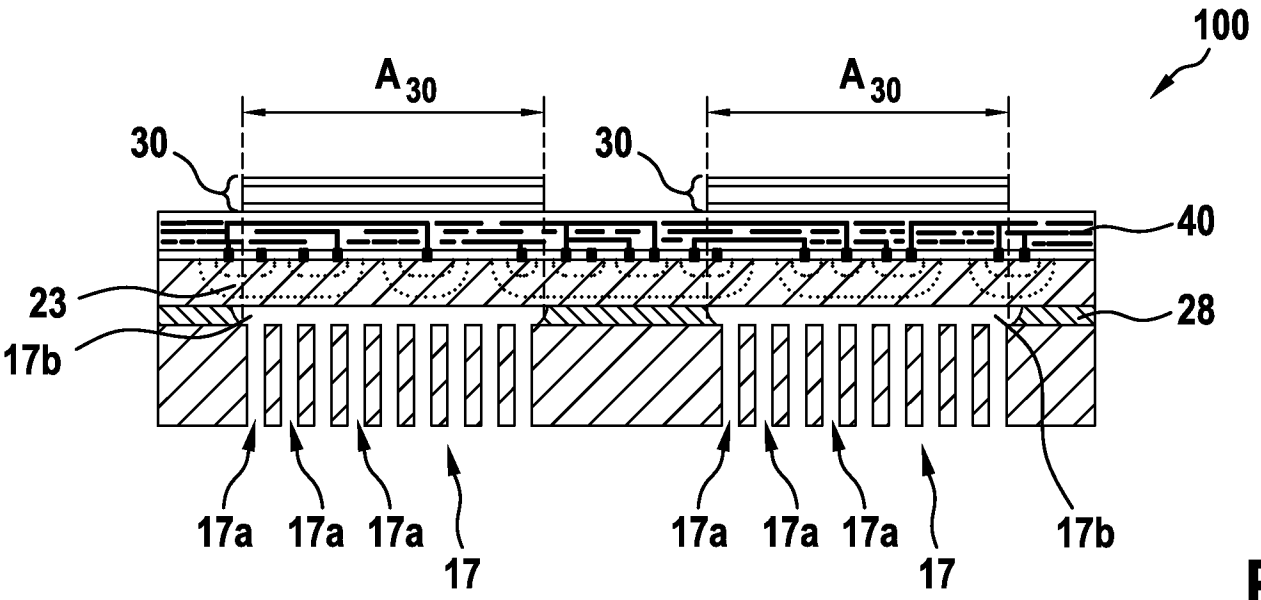

FIG. 8*a-c* each shows a cross-section of an ultrasound transducer device according to a fifth embodiment in a different manufacturing stage. This fifth embodiment of FIG. 8 is based on the fourth embodiment of FIG. 7. Thus, the explanations of the embodiment of FIG. 7 also apply for the embodiment of FIG. 8. Compared to the embodiment of FIG. 7, in the embodiment of FIG. 8 the substrate 10 further comprises a buried layer 28 (e.g. made of oxide) arranged on the substrate base layer 12, as can be seen in FIG. 8*a*. In other words, the substrate 10 is an ASIC processed on SOI having a buried layer. Referring to FIG. 8*b*, the plurality of adjacent trenches 17*a*, extending into the substrate base layer 12, are formed or etched (e.g. wet etching), in particular anisotropically. The trenches 17*a* are formed or etched from the second substrate side 10*b*. The etching is then stopped at the buried layer 28. Thus, the buried layer 28 acts as an etch stop layer. Then, as shown in FIG. 8*c*, the connecting cavity 17*b*, which connects the trenches 17*a*, is formed in the substrate 10 or buried (etch stop) layer 28. In this way, each cMUT cell 30 is provided on a separate membrane. The buried layer 28 is partly removed or etched to form the connecting cavity 17*b*. Remainders of the buried layer 28 are present on the sides of the connecting cavity 17*b*. It is possible to use the buried layer 28 as an etch stop layer so that a thin "floating" membrane 23 (e.g. silicon layer) is obtained. In this embodiment, the ASIC (layer) 40 (or part thereof) acts as the membrane 23.

FIG. 8*c* shows the final ultrasound transducer device 100 of this fifth embodiment. The ultrasound transducer device 100 comprises the at least one cMUT cell 30, as previously explained, and the substrate 10 (substrate base layer 12 with the ASIC 40) having the first side 10*a* and a second side 10*b*. The at least one cMUT cell 30 is arranged on the first side 10*a* of the substrate 10. The substrate 10 comprises the substrate base layer 12, and the plurality of adjacent trenches 17*a* extending into the substrate base layer 12 in a direction orthogonal to the substrate sides 10*a*, 10*b*. The spacers 12*a* (of the substrate base layer material) are each formed between adjacent trenches 17*a*. The substrate 10 further comprises the connecting cavity 17*b* which connects the trenches 17*a* and which extends in a direction parallel to the substrate sides 10*a*, 10*b*. The trenches 17*a* and the connecting cavity 17*b* together form the substrate cavity 17 in the substrate 10. The substrate 10 further comprises the substrate membrane 23 covering the substrate cavity 17, which is part of the substrate base layer 12 in this embodiment. The substrate cavity 17 is located in a region $A_{30}$ of the substrate 10 underneath the cMUT cell 30.

In the fifth embodiment of FIG. 8*c*, the connecting cavity 17*b* is formed or located in the buried layer 28, in particular above or over the trenches 17*a*. Thus, the substrate cavity 17 is formed or located in two separate layers. In the fifth embodiment of FIG. 8*c*, the substrate cavity 17 is not fully closed or sealed, because the trenches 17*a* are open to the second substrate side 10*b*. Optionally, the membrane may further comprise a high-density layer (e.g. made of Tungsten), as explained with reference to FIG. 3 to FIG. 6. For example, the high-density layer may be arranged on applied on the ASIC 40 (e.g. prior to the fabrication of the cMUT cell) to provide a high-inertia substrate 10.

The ultrasound transducer device 100 disclosed herein can in particular be provided as a cMUT ultrasound array, as for example explained with reference to FIG. 5. Such ultrasound transducer device 100 can in particular be used for 3D ultrasound applications. The ultrasound transducer device 100 can be used in a catheter or guide wire with sensing and/or imaging and integrated electronics, an intracardiac echography (ICE) device, an intra-vascular ultrasound (IVUS) device, an in-body imaging and sensing device, or an image guided intervention and/or therapy (IGIT) device.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. An ultrasound transducer device comprising:

at least one cMUT cell for transmitting and/or receiving ultrasound waves, the cMUT cell comprising a cell membrane and a cavity underneath the cell membrane, a substrate having a first side and a second side, the at least one cMUT cell arranged on the first side of the substrate, wherein the substrate comprises:

a substrate base layer, which is formed as a single layer, a plurality of adjacent trenches extending into the substrate base layer in a direction orthogonal to the substrate sides, wherein spacers are each formed between adjacent trenches, and a connecting cavity which connects the trenches and which extends in a direction parallel to the substrate sides, the trenches and the connecting cavity together forming a substrate cavity in the substrate, wherein the connecting cavity is formed entirely within the substrate base layer, and a substrate membrane between the at least one cMUT cell and the substrate cavity, and covering the substrate cavity, wherein the substrate cavity is located in a region of the substrate underneath the cMUT cell.

2. The ultrasound transducer device of claim 1, wherein the substrate cavity is located in at least the entire region of the substrate underneath the cell membrane of the cMUT cell.

3. The ultrasound transducer device of claim 1, wherein the substrate cavity has a pressure below the atmospheric pressure.

4. The ultrasound transducer device of claim 3, wherein the substrate cavity has a pressure of 10 mBar or less.

5. The ultrasound transducer device of claim 1, wherein the substrate membrane comprises a non-conformally deposited layer arranged over the substrate cavity.

6. The ultrasound transducer device of claim 5, wherein the non-conformally deposited layer comprises an oxide layer or nitride layer.

7. The ultrasound transducer device of claim 1, wherein the substrate membrane comprises a high-density layer made of a high-density material.

8. The ultrasound transducer device of claim 7, wherein the high-density layer has a mass which is sufficient to provide an inertial force which substantially opposes the acoustic pressure force developed by the cMUT cell during transmission of the ultrasound waves.

9. The ultrasound transducer device of claim 7, wherein the high-density material comprises Tungsten, Gold or Platinum.

10. The ultrasound transducer device of claim 7, the high-density layer comprising a plurality of adjacent trenches extending into the high-density layer in the direction orthogonal to the substrate sides.

11. The ultrasound transducer device of claim 1, wherein the cell membrane comprises a high-density layer made of a high-density material.

12. The ultrasound transducer device of claim 1, comprising a plurality of cMUT cells each mounted to the substrate, wherein a substrate cavity is located in each region of the substrate underneath a cMUT cell.

13. A method of manufacturing an ultrasound transducer device, the method comprising:

providing a substrate having a first side and a second side and having a substrate base layer, which is formed as a single layer, forming a plurality of adjacent trenches extending into the substrate base layer in a direction orthogonal to the substrate sides, wherein spacers are each formed between adjacent trenches, and forming a connecting cavity entirely within the substrate base layer, wherein the connecting cavity connects the trenches and which extends in a direction parallel to the substrate sides, the trenches and the connecting cavity together forming a substrate cavity in the substrate, arranging a substrate membrane covering the substrate cavity, and arranging at least one cMUT cell on the first side of the substrate and above the substrate membrane, wherein the substrate cavity is located in a region of the substrate underneath the cMUT cell.

14. The method of claim 13, wherein the plurality of adjacent trenches are formed using anisotropic etching.

15. The method of claim 13, wherein the connecting cavity is formed using isotropic etching.

* * * * *